US011712709B2

(12) United States Patent
Clements et al.

(10) Patent No.: US 11,712,709 B2
(45) Date of Patent: Aug. 1, 2023

(54) SPRAY APPLICATOR AND SPRAY UNIT

(71) Applicant: BALDWIN JIMEK AB, Arlöv (SE)

(72) Inventors: Wesley Clements, Arlöv (SE); Birger Hansson, Arlöv (SE); Frank Månsson, Arlöv (SE); Patrik Månsson, Arlöv (SE); Daniel Persson, Arlöv (SE)

(73) Assignee: BALDWIN JIMEK AB, Arlöv (SE)

( * ) Notice: Subject to any disclaimer, the term of this patent is extended or adjusted under 35 U.S.C. 154(b) by 0 days.

(21) Appl. No.: 17/802,011

(22) PCT Filed: Feb. 1, 2021

(86) PCT No.: PCT/EP2021/052318
§ 371 (c)(1),
(2) Date: Aug. 24, 2022

(87) PCT Pub. No.: WO2021/170346
PCT Pub. Date: Sep. 2, 2021

(65) Prior Publication Data

US 2023/0095206 A1 Mar. 30, 2023

(30) Foreign Application Priority Data

Feb. 28, 2020 (SE) ..... 2050227-4

(51) Int. Cl.
*B05B 1/04* (2006.01)
*B05B 13/02* (2006.01)
(Continued)

(52) U.S. Cl.
CPC ..... *B05B 13/0278* (2013.01); *B05B 1/044* (2013.01); *B05B 1/083* (2013.01);
(Continued)

(58) Field of Classification Search
None
See application file for complete search history.

(56) References Cited

U.S. PATENT DOCUMENTS 375,121 A 12/1887 Chappell
541,660 A 6/1895 Duffy
(Continued)

FOREIGN PATENT DOCUMENTS

AT 367321 B 6/1982
CA 1203375 A 4/1986
(Continued)

OTHER PUBLICATIONS

International Search Report and Written Opinion for PCT/EP2017/075534 dated Dec. 13, 2017.
(Continued)

*Primary Examiner* — Binu Thomas
(74) *Attorney, Agent, or Firm* — Thompson Coburn LLP

(57) ABSTRACT

A spray applicator (1) for spraying a fluid onto a web (W) of material has a first group of spray nozzles (10A) arranged along a first axis (FA) and a second group of spray nozzles (11A) arranged along a second axis (SA). The first (FA) and second (SA) spray nozzle axes are arranged on the same side of a plane in which the web (W) is run. Each spray nozzle (10A, 11A) has an elongated spray opening configured to spray fluid in a direction towards the web (W). The first spray nozzle opening of the first group of spray nozzles (10A) has an inclination angle which differs from the second nozzle opening inclination angle of the second group of spray nozzles (11A).

24 Claims, 9 Drawing Sheets

(51) Int. Cl.

| | |
|---|---|
| ***B05B 14/30*** | (2018.01) |
| ***B05B 1/08*** | (2006.01) |
| ***B05B 12/04*** | (2006.01) |
| ***B05B 12/12*** | (2006.01) |
| *D06B 1/02* | (2006.01) |

(52) U.S. Cl.
CPC ..... *B05B 12/04* (2013.01); *B05B 12/126* (2013.01); *B05B 14/30* (2018.02); *B05B 1/042* (2013.01); *B05B 13/0207* (2013.01); *D06B 1/02* (2013.01)

(56) References Cited

U.S. PATENT DOCUMENTS

| | | | | |
|---|---|---|---|---|
| 930,926 | A | | 8/1909 | Bentley |
| 1,051,846 | A | | 1/1913 | Brown |
| 3,273,805 | A | | 9/1966 | Hall |
| 3,447,756 | A | | 6/1969 | Lawrence, Jr. |
| 3,726,481 | A | * | 4/1973 | Foster ..... E01H 1/101 239/175 |
| 3,771,730 | A | * | 11/1973 | Nicoloff ..... B05B 9/01 239/536 |
| 3,776,471 | A | | 12/1973 | Meyer et al. |
| 3,814,322 | A | | 6/1974 | Waldrum |
| 3,908,408 | A | | 9/1975 | Getchell et al. |
| 3,930,464 | A | | 1/1976 | Wallsten |
| 3,987,964 | A | * | 10/1976 | Pittman ..... E01H 3/02 356/400 |
| 3,995,684 | A | | 12/1976 | Schmid |
| 4,023,385 | A | | 5/1977 | Hurd |
| 4,142,854 | A | | 3/1979 | Sando et al. |
| 4,231,318 | A | | 11/1980 | Zink |
| 4,247,047 | A | * | 1/1981 | Schaming ..... B05B 13/0207 239/557 |
| 4,656,063 | A | | 4/1987 | Long et al. |
| 4,738,400 | A | * | 4/1988 | Irwin ..... B05B 1/3006 239/536 |
| 5,071,072 | A | * | 12/1991 | Baun ..... B21B 45/0233 239/551 |
| 5,316,588 | A | | 5/1994 | Dyla |
| 5,342,657 | A | | 8/1994 | Budjinski et al. |
| 5,547,129 | A | | 8/1996 | Fortunato et al. |
| 5,967,418 | A | | 10/1999 | MacDonald et al. |
| 6,367,718 | B1 | | 4/2002 | Lotz |
| 7,621,286 | B2 | | 11/2009 | Frei et al. |
| 9,118,013 | B2 | | 8/2015 | Kaiho |
| 9,186,881 | B2 | | 11/2015 | Vinnay et al. |
| 11,077,458 | B2 | | 8/2021 | Månsson |
| 11,478,802 | B2 | | 10/2022 | Månsson et al. |
| 2003/0108678 | A1 | | 6/2003 | Wegehaupt |
| 2007/0125886 | A1 | | 6/2007 | Zillig et al. |
| 2008/0014361 | A1 | | 1/2008 | Johannessen |
| 2009/0282621 | A1 | | 11/2009 | Kennedy et al. |
| 2011/0189402 | A1 | | 8/2011 | Wagner |
| 2012/0024228 | A1 | * | 2/2012 | Lee ..... C23C 14/243 118/719 |
| 2012/0111431 | A1 | | 5/2012 | Singh |
| 2015/0375247 | A1 | | 12/2015 | Funseth et al. |
| 2019/0283047 | A1 | * | 9/2019 | Månsson ..... B05B 13/0207 |
| 2019/0344291 | A1 | * | 11/2019 | Vandepitte ..... B05B 13/0278 |
| 2020/0071788 | A1 | * | 3/2020 | Code ..... B05B 1/04 |
| 2020/0122165 | A1 | | 4/2020 | Choi et al. |
| 2020/0157718 | A1 | | 5/2020 | D'Herin Bytner |

FOREIGN PATENT DOCUMENTS

| | | | | |
|---|---|---|---|---|
| CA | 2084637 | C | | 9/2002 |
| CN | 1060044 | A | | 4/1992 |
| CN | 105142801 | A | | 12/2015 |
| DE | 1796280 | A1 | | 11/1972 |
| DE | 2711428 | A1 | | 9/1977 |
| DE | 3014542 | A1 | | 10/1981 |
| DE | 19646568 | A1 | | 5/1998 |
| DE | 102017111177 | A1 | | 11/2018 |
| EP | 0006763 | A2 | | 1/1980 |
| EP | 0060375 | A2 | | 9/1982 |
| EP | 0323316 | A2 | | 7/1989 |
| EP | 1413430 | B1 | | 6/2005 |
| EP | 2789397 | A1 | | 10/2014 |
| EP | 3069794 | A1 | | 9/2016 |
| EP | 3332955 | A1 | | 6/2018 |
| EP | 4053320 | A1 | * | 9/2022 |
| GB | 1306897 | A | | 2/1973 |
| GB | 1426442 | A | | 2/1976 |
| GB | 1474087 | A | | 5/1977 |
| GB | 2326609 | A | | 12/1998 |
| GB | 2326609 | B | | 1/2001 |
| GB | 2337984 | B | | 7/2003 |
| JP | S58128137 | A | | 7/1983 |
| JP | 3285384 | B2 | | 5/2002 |
| JP | 2006205086 | A | | 8/2006 |
| JP | 2008221328 | A | | 9/2008 |
| JP | 2011189659 | A | * | 9/2011 |
| KR | 20090004731 | U | | 5/2009 |
| WO | 2002090655 | A1 | | 11/2002 |
| WO | 2013002704 | A1 | | 1/2013 |
| WO | 2013158458 | A2 | | 10/2013 |
| WO | 2013167771 | A1 | | 11/2013 |
| WO | 2016162048 | A1 | | 10/2016 |
| WO | 2018/073025 | A1 | | 4/2018 |
| WO | 2018073026 | A1 | | 4/2018 |
| WO | 2019025707 | A1 | | 2/2019 |

OTHER PUBLICATIONS

International Search Report and Written Opinion for PCT/EP2017/075535 dated Dec. 8, 2017.
Swedish Search Report for Serial No. 1651370-7 dated Apr. 27, 2017.
Swedish Search Report for Serial No. 1651371-5 dated Apr. 27, 2017.

* cited by examiner

SPRAY APPLICATOR AND SPRAY UNIT

CROSS-REFERENCE TO RELATED APPLICATIONS

This application is a U.S. National Phase application of PCT/EP2021/052318, filed on Feb. 1, 2021, claiming the benefit of Swedish Application No. 2050227-4, filed on Feb. 28, 2020, both of which are incorporated herein by reference in their entireties.

TECHNICAL FIELD

The present invention relates in general to spraying of fluids on materials, such as a moving web of fabric, paper, board or the like, run through a spray applicator. The invention is in particular directed to devices configured to spray a liquid dye or coating on fabrics or the like, which are run as a web through a spray applicator.

BACKGROUND

Fluid spraying is a technique which may be used when coating different kinds of material. Various fluid spraying arrangements have been presented over the years, all with the same goal of achieving a uniform spray result. An example of such an arrangement is described in WO2018/073026A1, where a number of spray nozzles provide a spray pattern on a web run through a spray chamber.

The spray result of this known fluid spray arrangement is sufficient in many applications, but there is an increasing demand from the market for spray applicators by which an even more uniform spray result on the web is achieved. Hence, there is room for improvements.

Further background art is reflected for instance in WO2018/073025A1, WO02/090655A1, WO2013/167771A1, EP3332955A1 and U.S. Pat. No. 5,967,418A.

SUMMARY

An object of the present invention is to provide a novel spray applicator which is improved over prior art. This object is achieved by means of the technique set forth in the appended independent claims; preferred embodiments being defined in the related dependent claims.

In an aspect, there is provided a spray applicator for spraying a fluid onto a web of material, such as a fabric, paper or the like. The spray applicator has a first group of spray nozzles arranged along a first axis, and a second group of spray nozzles arranged along a second axis. The first and second spray nozzle axes are arranged on the same side of a plane in which the web is to be run. Furthermore, the first and second spray nozzle axes are spaced from each other and arranged substantially at the same distance from the web plane. Each spray nozzle has an elongated spray opening configured to spray fluid in a direction towards the web plane. Further, each nozzle of the first group of spray nozzles has its spray opening tilted a first nozzle opening inclination angle with respect to the first nozzle axis, whereas each nozzle of the second group of spray nozzles has its spray opening tilted a second nozzle opening inclination angle with respect to the second nozzle axis. The first nozzle opening inclination angle differs from the second nozzle opening inclination angle. The spray applicator of this aspect is favourable since a uniform spray result can be achieved for higher web speeds by adding more groups of spray nozzles. Furthermore, the tilting of the nozzle openings forms a spray pattern, or spray zone, that spans a larger surface area, reducing the volume of fluid needed for the spraying process.

An idea behind the present invention is—inter alia—the insight that it is favourable to arrange the spray nozzles aligned with each other in at least two groups or rows which are spaced from each other with respect to the feeding direction of the web. A further idea behind the invention is—inter alia—the insight that it is beneficial to arrange the spray nozzles with different tilting angles in the two spaced groups of spray nozzles. These features contribute to an improved and more uniform spraying result on the moving web.

In an embodiment, the first and second spray nozzle axes are substantially parallel with respect to the web plane. Hereby, a beneficial partial overlap between spray patterns can be obtained.

Preferably, the spray nozzles of each group of spray nozzles are spaced equidistantly along their respective spray nozzle axes. This is advantageous since a suitable partial overlap between the spray patterns coming from each group of spray nozzles is achieved.

The spray nozzles corresponding to the first and second groups of spray nozzles may be distributed in a direction substantially perpendicular to the direction of advancement of the web. This enhances a uniform spray result.

In an embodiment, the spray nozzles of the second group are arranged offset to the spray nozzles of the first group, or vice versa. Preferably, the offset constitutes 30-70% of the distance between two adjacent spray nozzles of the first or second group, wherein the offset (OS) preferably is 40-60% and most preferred substantially half (50%) of the distance. Thanks to the offset, a uniform spraying is obtained transversely across the web.

Preferably, each spray nozzle of the first and second group of spray nozzles is configured to form a fluid spray zone on the web, respectively, and the first group of spray nozzles defines a first set of spray cones and the second group of spray nozzles defines a second set of spray cones. This set-up further improves uniform spraying onto the web.

The first and second groups of spray nozzles may be arranged such that the first and second sets of spray cones provide spray zones which are configured to overlap each other at least partially on the web. Furthermore, each spray zone may have a substantially elongated shape corresponding to the shape of the associated spray nozzle opening. These features also contribute to uniform spraying.

In an embodiment, the inclination angle of the spray nozzle openings of the first and second group of spray nozzles, respectively, is substantially equal for each spray nozzle associated with its respective group, and is in the range of 15-60° with respect to the first and second spray nozzle axes, respectively. Hereby, a favourable spray pattern can be obtained. Preferably, the inclination angle is in the range of 20-45°.

The inclination angles may be related such that the absolute value or modulus of the first nozzle opening inclination angle is less than or equal to the absolute value of the second nozzle opening inclination angle. Hereby, for instance fish-bone shaped spray patterns can be obtained which are favourable for the uniformity of the spray pattern.

In an embodiment, each spray nozzle is associated with a valve connected to a control unit which preferably is configured to open and close the valve in a pulsing manner, such that a predetermined amount of fluid is ejected from each spray nozzle opening.

The pulsing is used for fluid volume control and is selected as a function of the speed of the web. This way, the control unit may be adaptable to web speeds for which a uniform spray pattern is not achievable by current technology.

In an embodiment, the spray applicator has an elongated chamber having a longitudinal centre axis, where the web plane includes the centre axis.

In another embodiment, each spray nozzle associated with each valve is arranged at an inner wall of the chamber.

In a further embodiment, each valve is rotatably mounted so that the nozzle opening inclination angle of the associated spray nozzle is adjustable within a range of angles between 15 and 60°, preferably in the range of 20-45°.

In yet another embodiment, the spray applicator has a dual spray nozzle arrangement including the first and second groups of spray nozzles forming a first half of the dual spray nozzle arrangement on one side of the web plane, and a corresponding second half of the dual spray nozzle arrangement on the other side of the web plane, for spraying on both sides of the web.

In a further aspect, there is provided a spray unit which has a spray applicator of any one of the designs described above.

BRIEF DESCRIPTION OF THE DRAWINGS

By way of example, embodiments of the present invention will now be described with reference to the accompanying drawings, in which.

DETAILED DESCRIPTION OF EMBODIMENTS

Figure 1:
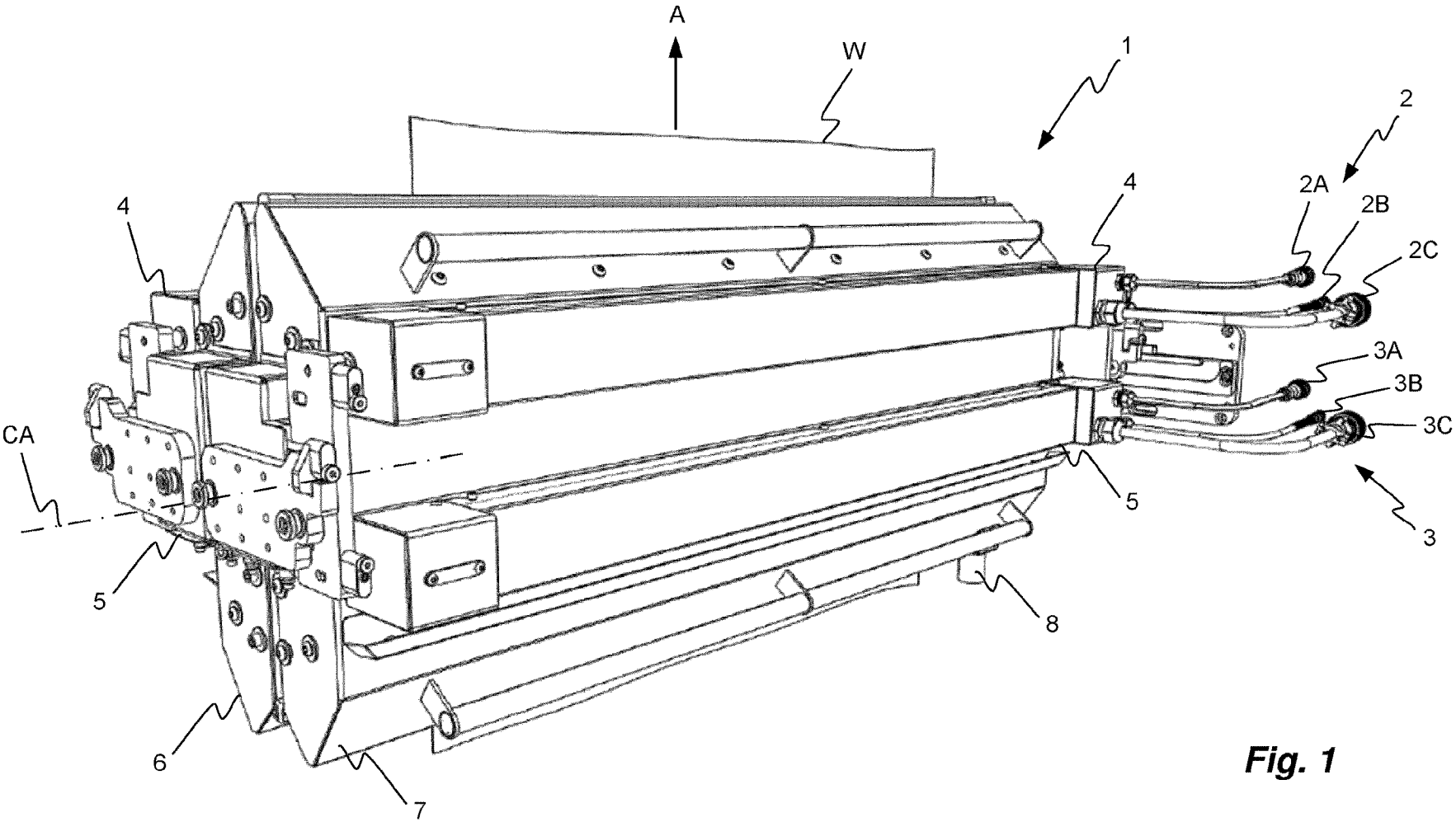
FIG. 1 is a perspective view of a spray applicator according to an embodiment of the invention.

With respect to FIG. 1 there is shown a spray applicator 1 which is configured to spray fluid onto a web W of material run through the spray applicator 1, preferably upwards in vertical direction as shown by an arrow A. In other words, the web W is moved or fed through the spray applicator 1 in a direction of advancement (arrow A). The material of the web W may for instance be non-woven, knitted or woven textile. The thickness of the web W may range from about 10 microns (μm) for film-like strips, and up to a few millimetres thick substrates. Thicker materials may also be subject to spraying in the spray applicator, depending on the purpose of the spraying and the aimed-at spraying result. The fluid may be a dyeing, finishing, or remoistening liquid which at least partially soaks the web W when sprayed thereon. The fluid may also be a liquid adapted to form a coating on a moving web-like substrate, such as a laminate flooring substrate.

The spray applicator 1 described herein is in particular but not exclusively applicable to a dyeing process where liquid dye is sprayed onto a moving web W of fabric or textile. The spray fluid is fed to the spray applicator 1 through two fluid supply conduits 2A and 3A connected to two elongated valve rails or spray bars 4 and 5, respectively. Furthermore, fluid return conduits 2B, 3B and power supply conduits 2C, 3C are connected to the spray bars 4, 5. Two corresponding spray bars are provided on the opposite side of the spray applicator 1, and these spray bars have corresponding supply means as described above.

Figure 11:
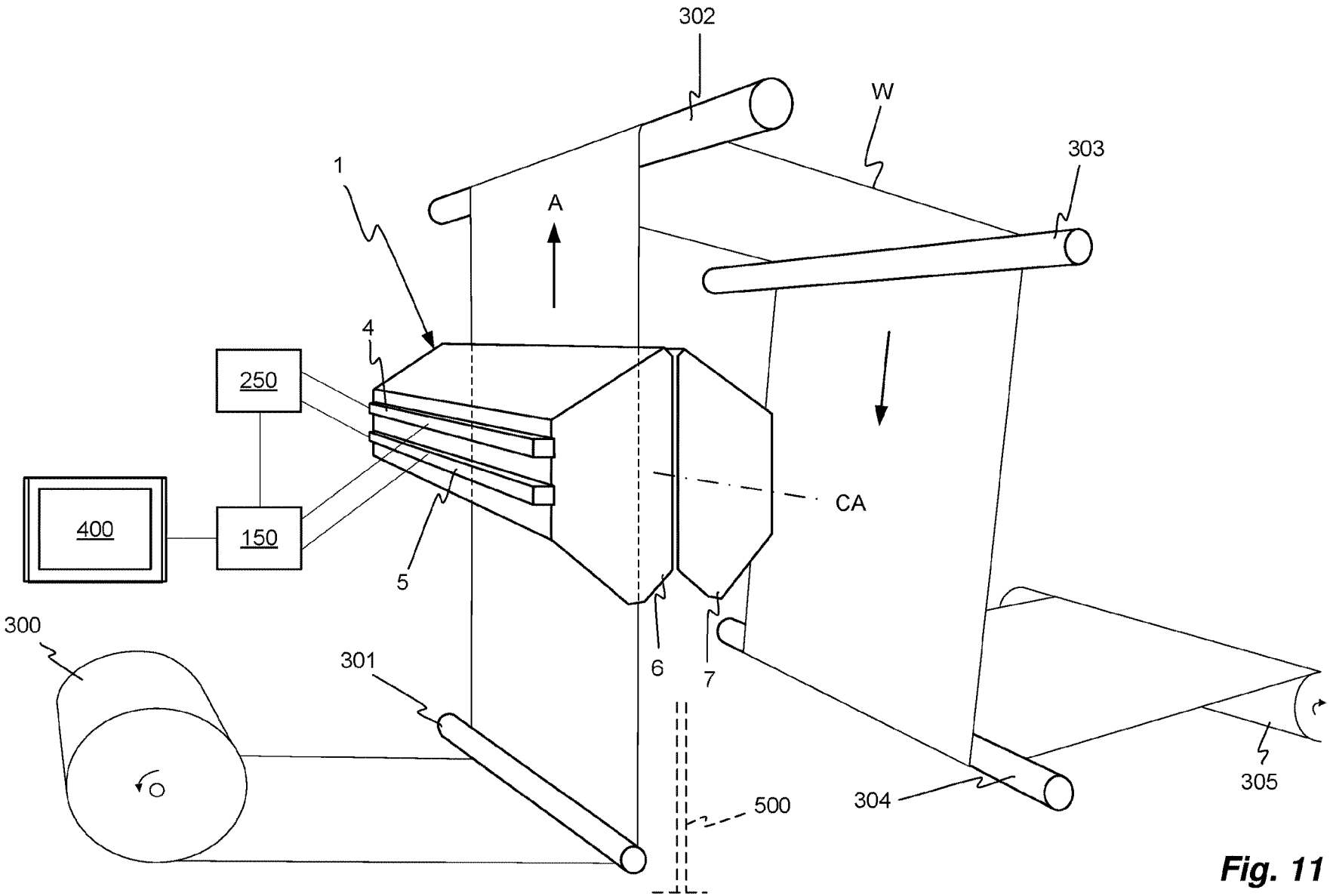
FIG. 11 is a schematic illustration of a spray unit including the spray applicator.

As illustrated in FIG. 11, the spray applicator 1 is arranged in a spray unit which also includes roller means 301, 302, 303, 304 for guiding the flexible web W through the spray applicator 1. The non-sprayed web is unwound from a first roll 300 before the spray applicator 1 with respect to the feeding direction (arrow A) and the sprayed web is wound onto a driven second roll 305 after the spray applicator 1. The spray unit also includes fluid source means 250 connected to the fluid supply conduits 2A, 3A and to the control unit 150.

Structurally, the spray applicator 1 includes two halves or shroud members 6 and 7 which when brought together form an enclosure in the shape of an elongate spray chamber 6, 7 having a centre axis CA. As shown in FIG. 1, the web W runs in a central plane P between the two shroud members 6, 7 (see plane P indicated with dashed lines in FIG. 5). The spray chamber may for instance be an enclosure of the general type disclosed in the applicant's publication WO2018/073025A1 mentioned above.

Figure 2:
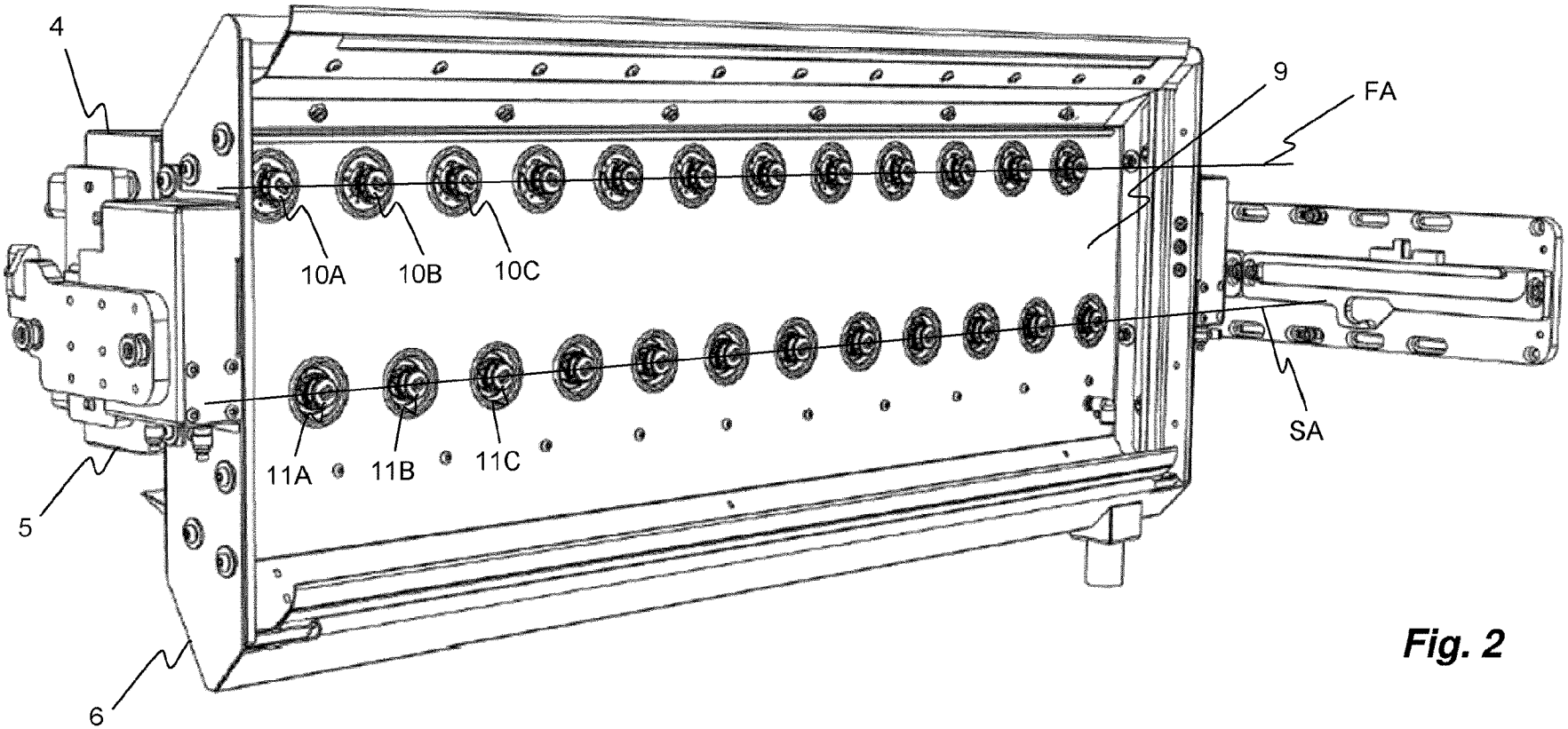
FIG. 2 is a perspective view of an inside of a first shroud member of the spray applicator of FIG. 1 provided with spray nozzles.

The shroud member 6 is shown in more detail in FIG. 2. Residual fluid from the spraying is collected at a lower portion of the spray chamber 6, 7 and is removed or discharged via a drain pipe 8.

At an inner wall 9 of the shroud member 6 there is provided two groups or rows of spray nozzles 10A, 10B, 10C, etc., and 11A, 11B, 11C, etc. The first or upper group of spray nozzles 10A, 10B, 10C, etc., is arranged along a first axis FA whereas the second or lower group of spray nozzles 11A, 11B, 11C, etc., is arranged along a second axis SA. The aligned spray nozzles are distributed in a direction substantially perpendicular to the direction of advancement of the web W in the spray applicator 1. The two axes FA and SA are parallel and spaced from each other with respect to the web feeding direction A (see FIG. 1). Preferably, the two axes FA and SA are also parallel to the centre axis CA of the spray chamber 6, 7 (see FIG. 1). Furthermore, the two axes FA and SA are arranged at the same distance D from the plane P in which the web W runs (see FIG. 7). As shown in the figures, the two axes FA and SA extend transversely or perpendicular to the feeding direction A of the web.

Figure 3:
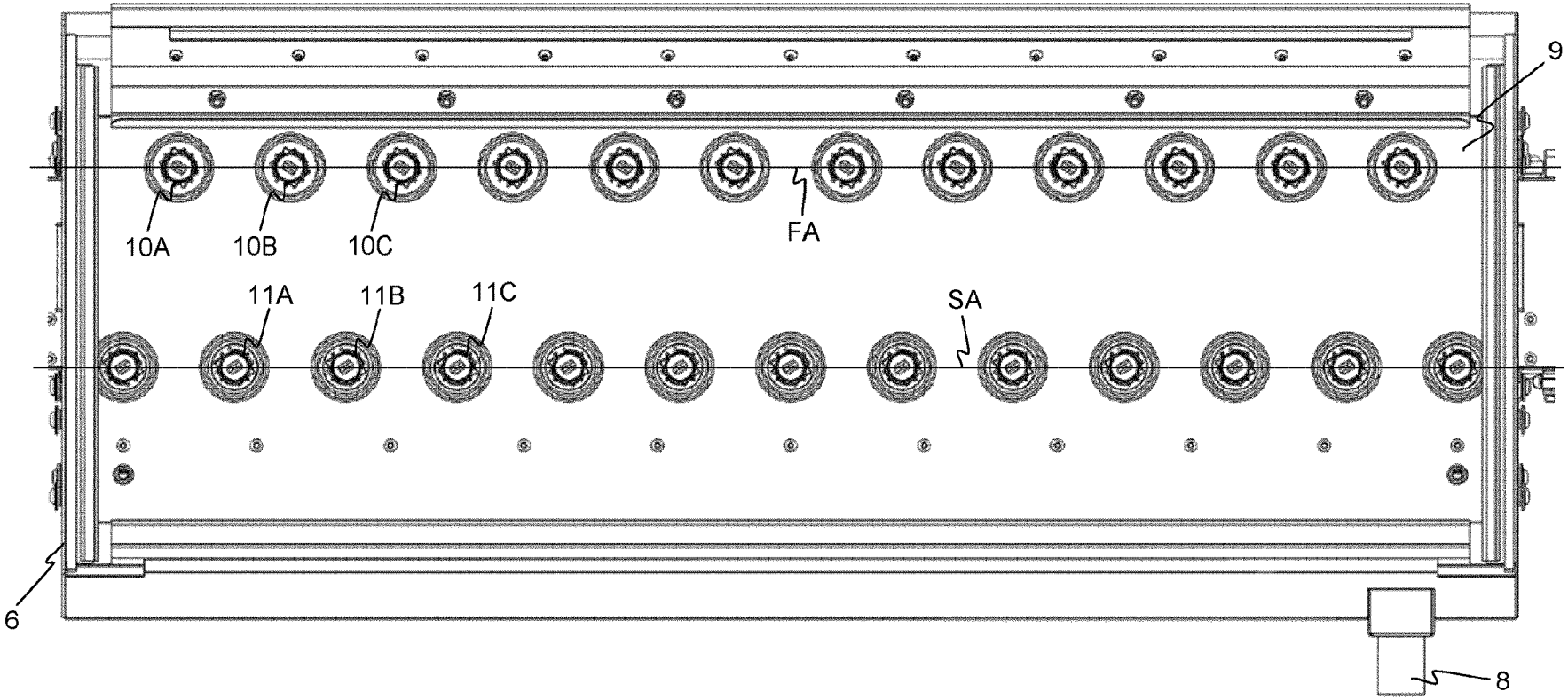
FIG. 3 is a front view of the first shroud member shown in FIG. 2.
Figure 4:
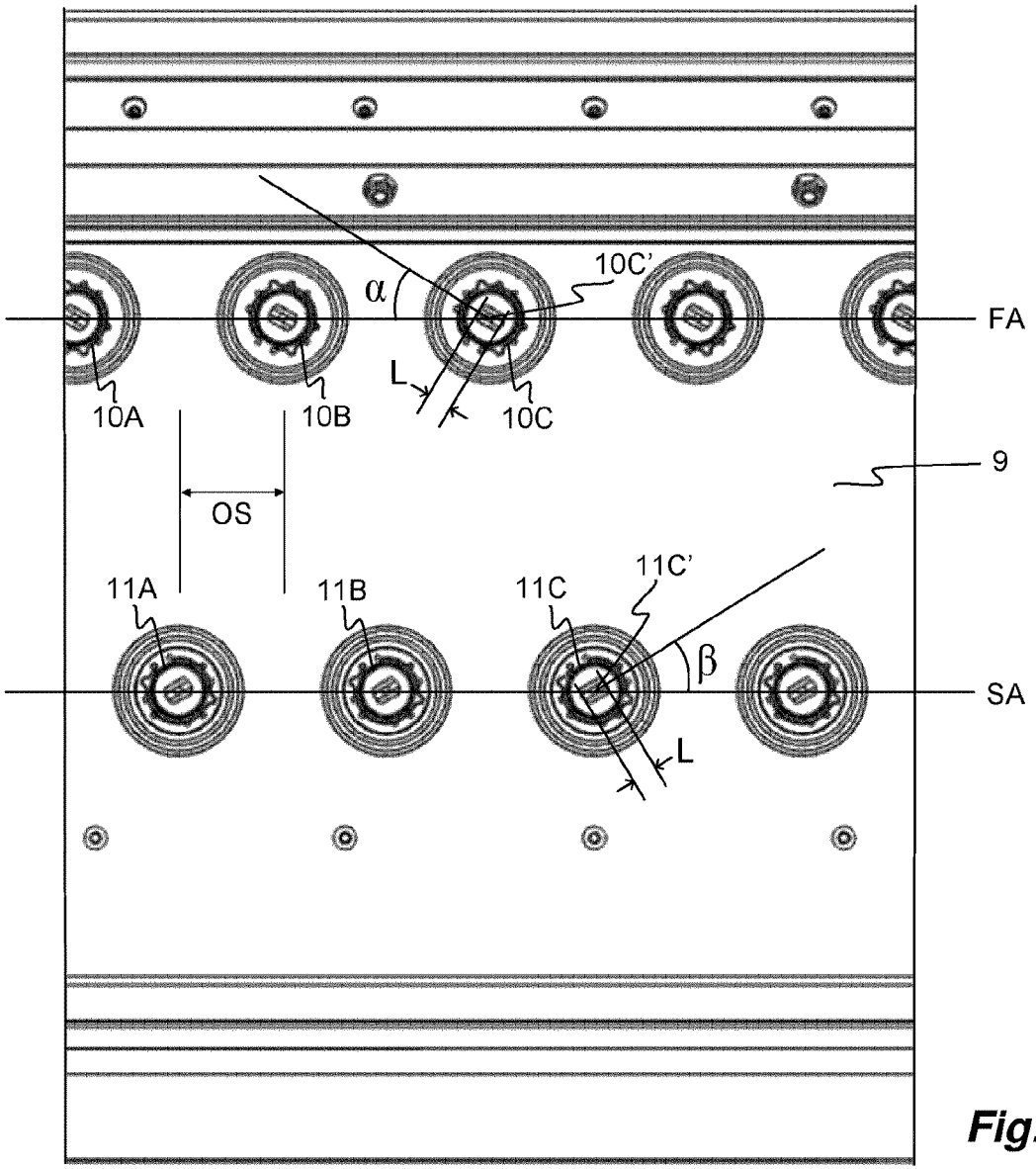
FIG. 4 shows on a larger scale a portion of the first shroud member of FIG. 2.

In FIG. 3 the two groups of spray nozzles 10A, 10B, 10C, etc., and 11A, 11B, 11C, etc., respectively are shown in a plan view. The spray nozzles are spaced equidistantly along their respective spray nozzle axes FA and SA. Furthermore, it is shown in FIG. 3 that the spray nozzles 11A, 11B, 11C, etc., of the second group along the axis SA are offset the spray nozzles 10A, 10B, 10C, etc., of the first group. The offset OS may for instance be 30-70% of the distance between two adjacent spray nozzles, preferably within the range of 40-60%. Even more preferably, the offset OS is substantially half the distance between two adjacent spray nozzles. In FIG. 4, the offset OS is shown to be approximately half (50%) of the distance between two adjacent spray nozzles.

In the example described herein, the first group contains twelve aligned spray nozzles 10A, 10B, 10C, etc., and the second group contains thirteen aligned spray nozzles 11A, 11B, 11C, etc. However, the number of spray nozzles can vary depending on the type of material of the web W to be sprayed, the width of the web W, the volume of fluid to be sprayed onto the web W, etc.

The close-up of FIG. 4 shows in more detail the design of the spray nozzles 10A, 10B, 10C, etc., and 11A, 11B, 11C, etc., aligned along the first spray nozzle axis FA and the second spray nozzle axis SA. Using the spray nozzle 10C of the first group of nozzles for illustration purposes, it is shown in FIG. 4 that the spray nozzle 10C has an elongated spray nozzle opening 10C' with a length L. The spray nozzle opening 10C' which is also referred to as a flat spray nozzle opening, is tilted or inclined an angle $\alpha$ in relation to the first spray nozzle axis FA. All spray nozzles 10A, 10B, 10C, etc., of the first group of spray nozzles have a spray opening tilted the same angle $\alpha$ which is also referred to as the first nozzle opening inclination angle $\alpha$ with respect to the first spray nozzle axis FA.

This first inclination angle $\alpha$ is within the range of 15-60°, preferably 20-45° and in particular 25-35°. In practical tests run with the spray applicator 1 described herein, a first inclination angle $\alpha$ of about 25° was used. Hereby, favourable results were obtained in terms of a more uniform spray pattern or footprint on the web W compared to spray equipment known in the art.

The spray nozzles 11A, 11B, 11C, etc., of the second group are arranged in a similar way. Using the spray nozzle 11C of the second group of nozzles for illustration purposes, it is shown that the spray nozzle 11C has an elongated spray nozzle opening 11C' with a length L. The spray opening 11C' which is also referred to as a flat spray nozzle opening, is tilted or inclined an angle $\beta$ in relation to the second spray nozzle axis SA. All spray nozzles 11A, 11B, 10C, etc., of the second group of spray nozzles have a spray opening tilted the same angle $\beta$ which is also referred to as the second nozzle opening inclination angle $\beta$ with respect to the second spray nozzle axis SA. This second inclination angle $\beta$ is within the range of 15-60°, preferably 20-45° and in particular 25-35°. In practical tests, a second inclination angle $\beta$ of about 25° has led to favourable spray footprint results in the practical tests mentioned above.

In the examples shown herein, the first and second nozzle inclination angles $\alpha$ and $\beta$ have the same absolute value (about 25°) but they are tilted in opposite directions with respect to the two parallel nozzle axes FA and SA, respectively. Hence, the two spray nozzle inclination angles $\alpha$ and $\beta$ differ from each other in terms of tilting direction.

In other embodiments (not shown), the spray nozzle openings of the first and second group, respectively, can be tilted in the same direction but then have different values; for instance 20° tilting in the first group and 45° in the second group. Thus, also in this case the two spray nozzle inclination angles differ from each other.

The selection of tilting direction and the degree of tilting within the first and second group of spray nozzles, respectively, may vary depending on what kind of spray pattern one wishes to obtain on the web by means of the two groups of aligned spray nozzles.

Figure 5:
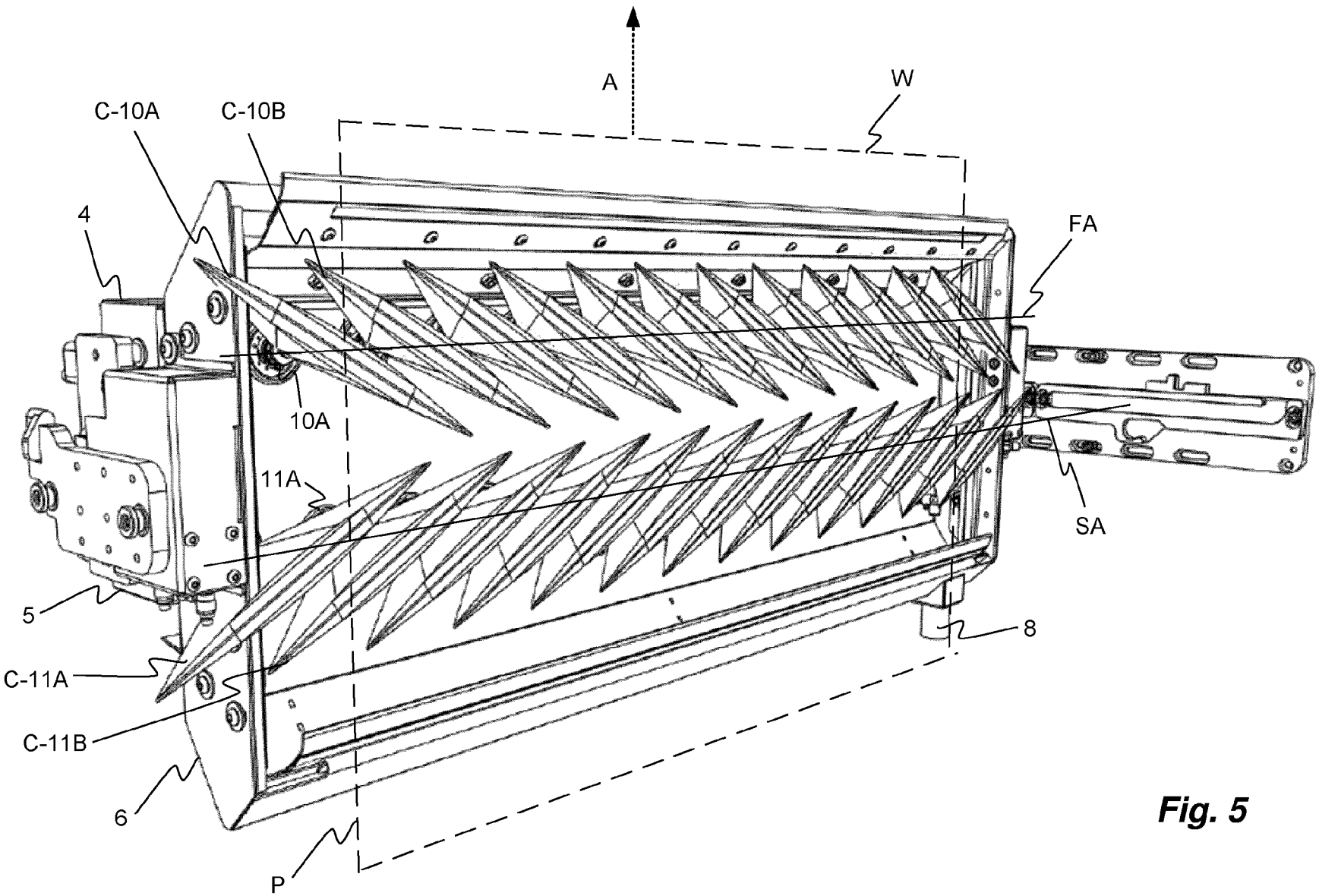
FIG. 5 is a view corresponding to FIG. 2 with the spray nozzles in their active mode providing inclined spray cones.

In FIG. 5, the spraying process is shown in operation. Thanks to the tilted spray nozzle openings of the spray nozzles 10A, 10B, 10C, etc., and 11A, 11B, 11C, etc., a fish-bone like spray pattern is obtained on the web W which is shown in dashed lines for illustration. This means that each spray nozzle of the first and second group of spray nozzles is configured to form an inclined flat spray zone on the web, respectively. This fish-bone pattern can only be seen in reality if taken in a momentary "snapshot" during the spraying process. Moreover, to achieve a uniform spray coverage on the web W when moving through the spray applicator, the fish-bone pattern is desirable only when superimposed along with other fish-bone patterns.

The first group of spray nozzles 10A, 10B, 10C, etc., along the first axis FA defines—in spray operation mode—a first set of spray cones C-10A, C-10B, etc., which is configured to provide spray zones Z-10A, Z-10B, etc., on the web W, and the second group of spray nozzles 11A, 11B, 11C, etc., along the second axis SA defines—in spray operation mode—a second set of spray cones C-11A, C-11B, etc., which is configured to provide spray zones Z-11A, Z-11B, etc., on the web W. The first and second groups of spray nozzles are arranged such that first and second sets of spray cones provide spray zones Z-10, Z-11 (see FIG. 6) which overlap each other at least partially on the web W when it is run through the spray applicator 1. Each spray zone or cone C-10A, C-10B, etc., C-11A, C-11B, etc., has a substantially elongated shape corresponding to the shape of the associated spray opening.

Figure 6:
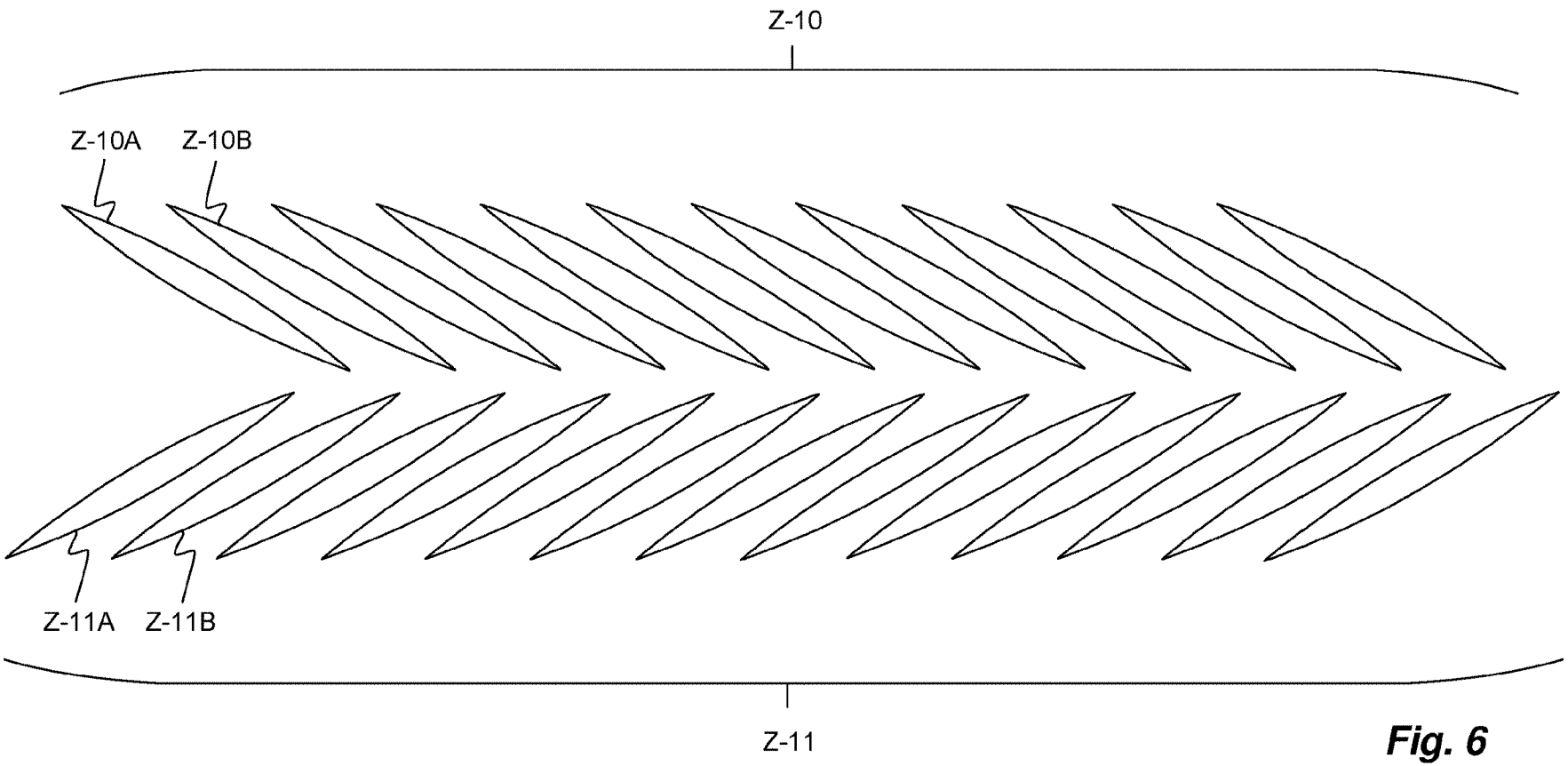
FIG. 6 is a schematic illustration of a spray pattern obtained by the spray cones shown in FIG. 5.

The spray pattern footprint obtained on the web W is diagrammatically shown in FIG. 6. Thanks to the set up with two spray bars 4, 5 with spray nozzles which are aligned in two groups spaced from each other and which have the differing inclination angles described above, a favourable uniform spraying on the web W is obtained. In FIG. 6, the fish-bone spray pattern is illustrated with distinct footprints Z-10A, Z-10B, etc., Z-11A, Z-11B, etc., on the web W, but in practice a certain overlap of the spray footprints is obtained which is favourable. This overlap will be further described in relation to FIG. 10 below.

Figure 7:
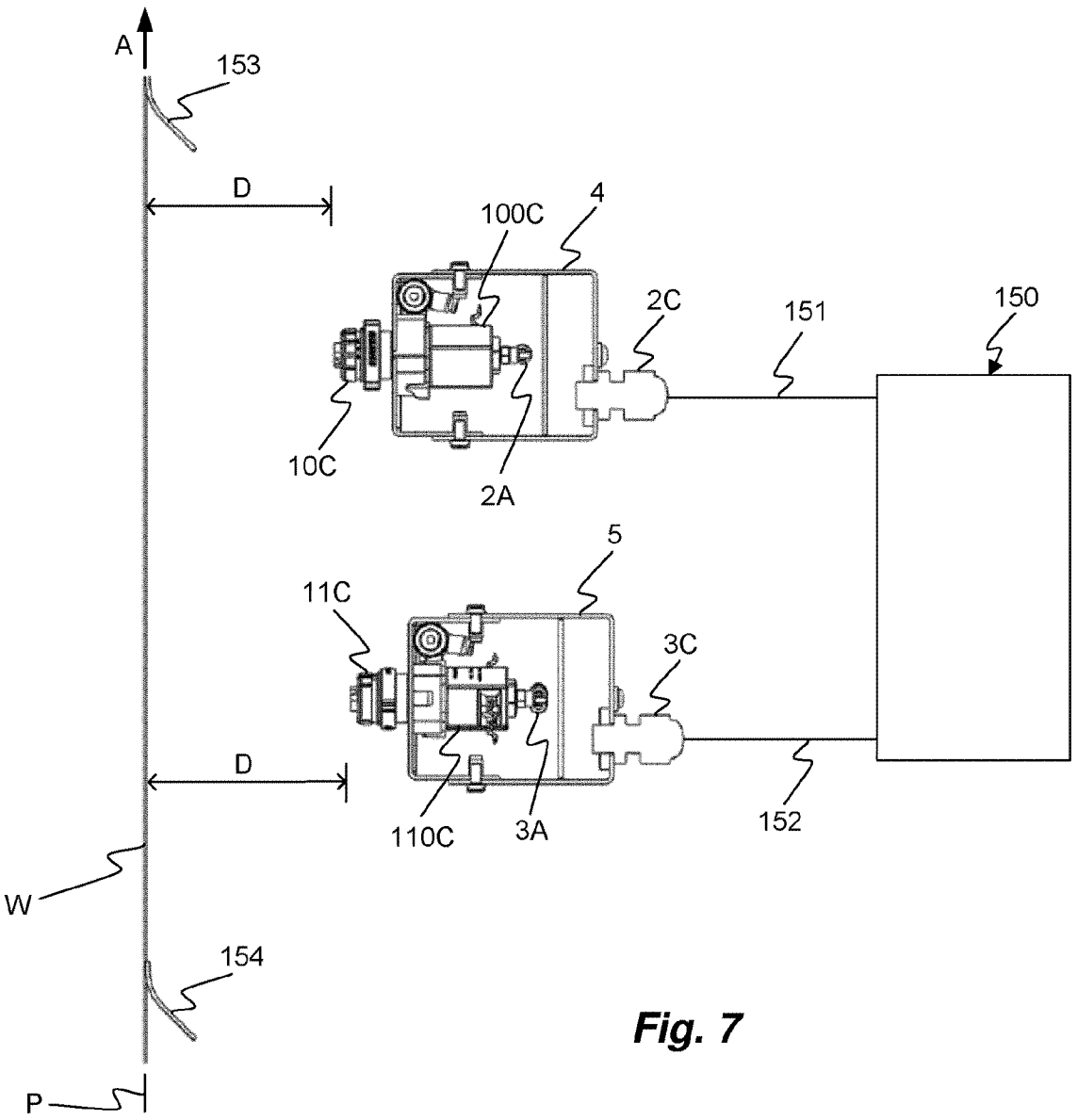
FIG. 7 is a schematic side view of two spray bars of the spray applicator shown in FIG. 1.

With reference to FIG. 7, the two spray bars 4 and 5 are shown separately for illustration purposes. The spray nozzle 10C of the first group of spray nozzles aligned along the first axis FA (see FIG. 4) is arranged at the same distance D from the web W as the spray nozzle 11C of the second group of spray nozzles aligned along the second axis SA (see FIG. 4). This contributes to a secure and uniform spraying on the web W. Preferably, the distance D is adjustable depending on the inclination angles used as well as the physical and/or chemical properties, such as the rheological characteristics, of the fluid to be sprayed.

In FIG. 7, it is also shown that the upper spray bar 4 includes a high-speed valve 100C which is associated with a spray nozzle (10C is shown in FIG. 7), and that the lower spray bar 5 includes a high-speed valve 110C associated with the spray nozzle 11C. This arrangement will be further described below.

Before further describing the arrangement of FIG. 7, a general discussion of the pulsing or fluid control concept is provided. The pulsing of fluid is achieved and controlled by a control unit 150 shown in FIG. 7. More specifically, the control unit 150 is configured to control, or regulate, the rate at which a predetermined volume, or amount, of fluid is ejected from each spray nozzle opening onto the web W. This is done by opening and closing the valves 100C, 110C at a certain pulsing rate, or frequency, which is selected as a function of the fluid volume required and the speed of the web W run through the spray applicator. Furthermore, the control unit 150 is configured to control the pulsing rate in a way such that the valves 100C, 110C of the first and second group of spray nozzles open and close in a synchronised manner. In certain circumstances, such as when flow control is not required, the fluid may be ejected with a continuous flow as well and is not bound by the pulsing.

As shown in FIG. 7, the control unit 150 is in communication with the high-speed valves 100C, 110C which are connected to their respective spray nozzle 10C, 11C. The connection is illustrated by two electrical conduits 151, 152. The control unit 150 is controlled by software developed for the pulsing of the valves of the respective spray bar 4, 5 in order to achieve the target volume flow from the spray nozzles 10C, 11C associated with the valves 100C, 110C. It should be noted that the control unit 150 is equally connected to the rest of the spray nozzles associated with the first group of spray nozzles 10A, 10B, 10C etc., and the second group of spray nozzles 11A, 11B, 11C etc., by corresponding electrical conduits. Furthermore, each spray nozzle along the first and second axes, respectively, is provided with a valve as the ones just described in relation to the exemplifying nozzles 10C and 11C.

With reference to the supply systems 2, 3 shown in FIG. 1 it should be mentioned that end connectors of the fluid supply conduits 2A and 3A are connected to the valves 100C and 110C, and that end connectors of the electrical conduits 2C and 3C are connected to the spray bars 4, 5 in the way illustrated in FIG. 7. Further connecting and supply conduit means are included in the spray bars, but these assemblies are not shown here.

Figure 9:
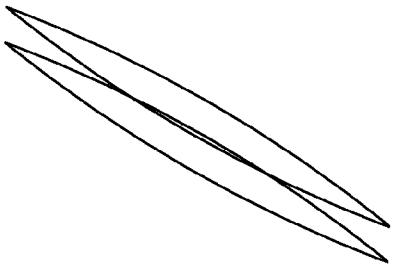
FIG. 9 is a schematic illustration of a spray pattern obtained by a first spray bar after pulsed fluid ejection.
Figure 8:
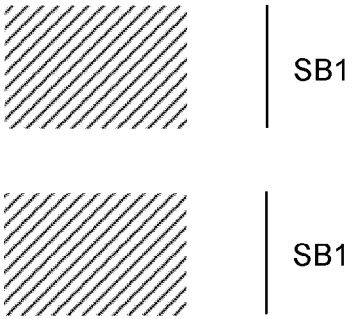
FIG. 8 is a schematic illustration of a general spray pattern obtained by a first spray bar after pulsed fluid ejection.

FIG. 8 shows a simplified spray pattern resulting from a non-specific, generalised spray nozzle coming from one single spray bar SB1 (not shown in detail). Here, the rectangular-shaped spray zones (wet areas) are spaced by a distance (dry area) as the web runs in front of the nozzle. This is a result of a relatively slow pulsing (with respect to web speed) where the valve associated with the spray nozzle in question has been opened, closed and then opened again for a certain time period. In other words, given a certain pulsing rate, the distance between the wet and dry areas in FIG. 8 will be a function of the speed of the web W. Thus, for lower web speeds with a faster pulsing, a partial overlap of the wet areas will be achieved. In FIG. 9, another pattern is shown, which illustrates this overlap.

For higher web speeds, further spray bars (not shown) may be introduced. Thus, the number of spray bars can be varied to suit the web speed and the flow, or volume, of fluid used in the dyeing process. For example, a web speed of more than approximately 100 m/min may require more than two spray bars.

Figure 10:
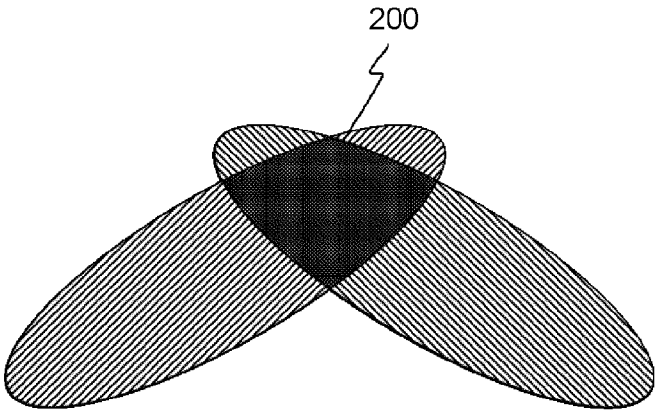
FIG. 10 is a schematic illustration of a spray overlap footprint on a web fed through a spray applicator with tilted nozzles as shown in FIG. 5.

With the arrangement of the spray bars 4, 5 shown in for instance FIG. 7, the generalised spray pattern shown in FIG. 10 may be realised, through the pulsing provided by the control unit 150, in a shape that corresponds to the opening of a nozzle with the first nozzle opening inclination angle $\alpha$ with respect to the first nozzle axis FA.

As is understood from for instance FIGS. 2 and 7 studied together, each spray nozzle 10C and 11C associated with each valve 100C and 110C, respectively, is arranged at the inner wall 9 of the spray chamber 6, 7. The spray nozzles are mounted or secured to the spray bars 4, 5—via the valves—and protrude through apertures (not shown) provided in the inner wall 9 of the related shroud member 6, 7 of the spray chamber. All spray nozzles arranged along the first axis FA and the second axis SA are provided with valves to spray fluid onto the moving web W.

One way of describing the overlap between the different spray zones Z-10, Z-11 on the web W is to observe the action of just two spray nozzles coming from two separate groups of nozzles, for example nozzle 10C and 11C, where 10C in this case is associated with a first group of spray nozzles inclined with an angle $\alpha$, and 11C is associated with a second group of spray nozzles inclined with an angle $\beta$. In FIG. 10, the spray patterns or zones of the two spray nozzles are overlapping in an area depicted as 200. This is a result of the offset between the nozzle positions of the first and second groups as well as the choice of inclination angles. In this case, $|\alpha|=|\beta|$, meaning that the absolute value of the first nozzle opening inclination angle $\alpha$ is equal to the absolute value of the second nozzle opening inclination angle $\beta$. For example, when the web W is run and the liquid is ejected in a pulsing manner onto the web, the nozzle 10C gives (on its own) rise to multiple spray patterns or zones that overlap each other at least partially in a direction A corresponding to the movement of the web. The same happens for nozzle 11C, but at a certain distance (in FIG. 10 on the right side of) from the first nozzle 10C. On a larger scale, these features combined then lead to a uniform spray pattern where the sprayed areas not covered by some nozzles are covered by others.

The valves 100C and 110C corresponding to the two groups of valves aligned along the first axis FA and the second axis SA, respectively, are rotatably mounted in their seats so that the spray nozzle opening 10C', 11C' of the associated spray nozzle 10C, 11C is adjustable between distinct inclination angles, preferably stepwise at 20°, 25°, 30° and 35°. Hereby, the spray applicator can swiftly be adapted to the aimed-at spray pattern to be provided on the web W. In an alternative embodiment, the valves are freely rotatable within the preferred angular range of 20-45° and possible to lock in any suitable tilt angle within this range. One of the purposes of this feature is to compensate for possible rheological effects coming from different fluids. Practical tests have shown that this feature can also be used to provide even spray distribution at lower coverages than what is possible with spray equipment known in the art.

The spray chamber 6, 7 is preferably provided with upper and lower elongated sealing elements which are in contact with the moving web W during operation. Hereby, the leakage of spray fluid from the spray chamber is reduced. These sealing elements are here shown in the shape of an upper elastic sealing lip 153 and a lower elastic sealing lip 154 (see FIG. 7). Preferably, these sealing lips 153, 154 are made from some kind of rubber material.

The spray bars 4, 5 are detachably mounted to the outside of the spray chamber 6, 7 shown in FIG. 1. Hence, each spray bar 4, 5 can be removed from its shroud member 6 and 7, respectively, for cleaning of the spray nozzles or replacement of valves, etc. The spray bars 4, 5 may also be subject to planned maintenance which is easy to perform on the described spray applicator 1.

With reference to the schematic FIG. 11, the spraying arrangement or spray unit described by way of example above is operated in the following manner:

1) A pressurized fluid source 250 is connected to the spray bars 4, 5 of the spray applicator 1 through the connections 2A and 3A shown in FIG. 1.
2) The flexible web W is fed through the spray applicator 1 in a direction of advancement A using guide rollers 301, 302, 303, 304 before and after the spray applicator 1.
3) Using an interface panel 400 connected to the controller 150, the operator inputs the fluid coverage rate to be applied to each side of the web W. This fluid coverage rate is expressed in weight divided by area. In the metric system, grams per square meter (gsm) is generally used. In the imperial system, ounze (oz) per square yard is customary.

4) Maximum fluid coverage rate available from the system is governed by the size and therefore volume flow rating of each nozzle. For example, standard spray nozzles used in the spray applicator 1 will provide a maximum coverage of 70 gsm per side at a web speed of 100 m/min. At maximum flow, the valve behind each nozzle is fully open.
5) The controller 150 individually pulses the valve behind each nozzle to provide the functionality to provide constant coverage rate (gsm) across the speed range. For example, if 70 gsm is required at a web speed of 50 m/min (=half speed), then the pulsing will be such that the valve is open for 50% of the time and closed for 50% of the time.
6) The controller 150 also enables lower coverages than 70 gsm to be achieved. For example, if the operator selects 35 gsm, and the web speed is 50 m/min, the controller algorithms will open the valves for 25% of the time and close 75% of the time.
7) Using the logic outlined in items (5) and (6) above, the controller 150 allows the operator to select a desired coverage rate typically between 20% and 100% of the maximum rating (70 gsm in this example) and ensure that this coverage level is maintained across the speed range of the spray unit. Practical tests have shown that coverage rates from below 10% to 100% can be achieved.
8) If needed, during commissioning trials, the tilting angle of the spray nozzles is adjusted and set in such way that the fluid spray footprint is achieved on the web W fed through the spray applicator 1. This may be needed if using a fluid with different rheological characteristics. It is a favorable feature of the spray unit described herein. Practical tests have shown that this feature enables uniform spray distribution to be obtained at lower coverages (10% of nozzle capacity) than what is possible with spray equipment known in the art.

The elongated spray applicator 1 shown in FIG. 11 is supported at its opposite ends by a frame structure 500 (schematically shown in dashed lines) placed on the floor of the building in which the spray line is installed.

It should be mentioned that one or more of the connections, selections, adjustments and settings outlined above can be controlled by further control means not described here. Furthermore, some of the settings can—if suitable—be performed manually by the operator in charge of the operation of the spray unit.

It is appreciated that the inventive concept is not limited to the embodiments described herein, and many modifications are feasible within the scope of the appended claims. For instance, the inventive spray applicator is not bound to two parallel groups of spray nozzles as shown in the examples above. There may also be more than two groups of spray nozzles, for instance three or four parallel spray bars at the same side of the web. Even though the above description is related to spraying on the web from one side, it is also possible—and oftentimes preferred—to spray from both sides. Then two similar spray bars are in operation on both sides of the web plane.

Furthermore, the first nozzle axis and the second nozzle axis may be slightly inclined with respect to the centre axis of the spray chamber and/or in relation to each other. For example, the spray bar related to the first axis may be tilted a certain angle in relation to the centre axis, while the nozzle openings on the same spray bar may have an angle of inclination which is greater than or zero. Finally, it should be mentioned that the spray applicator can be used for pretreatment of paper and textile fabrics for digital printing and the like. It is appreciated that the inventive spraying concept is applicable to many different types of materials.

The invention claimed is:

1. A spray applicator for spraying a fluid onto a web of material, comprising:

a first group of spray nozzles arranged along a first spray nozzle axis; and a second group of spray nozzles arranged along a second spray nozzle axis;

said first and second spray nozzle axes being arranged on the same side of a plane in which said web is to be run;

said first and second spray nozzle axes being spaced from each other and arranged substantially at the same distance from said web plane;

each spray nozzle having an elongated spray opening configured to spray fluid in a direction towards said web plane;

each nozzle of said first group of spray nozzles having its spray opening tilted a first nozzle opening inclination angle with respect to said first nozzle axis;

each nozzle of said second group of spray nozzles having its spray opening tilted a second nozzle opening inclination angle with respect to said second nozzle axis;

wherein said first nozzle opening inclination angle differs from said second nozzle opening inclination angle.

2. The spray applicator according to claim 1, wherein said first and second spray nozzle axes are substantially parallel with respect to said web plane.

3. The spray applicator according to claim 1, wherein the spray nozzles of each group of spray nozzles are spaced equidistantly along their respective spray nozzle axes.

4. The spray applicator according to claim 1, wherein the spray nozzles corresponding to the first and second groups of spray nozzles are distributed in a direction substantially perpendicular to the direction of advancement of said web.

5. The spray applicator according to claim 1, wherein the spray nozzles of the second group are arranged offset to the spray nozzles of the first group, or vice versa.

6. The spray applicator according to claim 5, wherein said offset constitutes 30-70% of the distance between two adjacent spray nozzles of said first or second group.

7. The spray applicator according to claim 1, wherein each spray nozzle of said first and second group of spray nozzles is configured to form a fluid spray zone on said web, respectively, and wherein the first group of spray nozzles defines a first set of spray cones and the second group of spray nozzles defines a second set of spray cones.

8. The spray applicator according to claim 7, wherein said first and second groups of spray nozzles are arranged such that said first and second sets of spray cones provide said spray zones which are configured to overlap each other at least partially on said moving web.

9. The spray applicator according to claim 7, wherein each spray zone has a substantially elongated shape corresponding to the shape of the associated spray nozzle opening.

10. The spray applicator according to claim 1, wherein said inclination angles are related such that the absolute value of the first nozzle opening inclination angle is less than or equal to the absolute value of the second nozzle opening inclination angle.

11. The spray applicator according to claim 10, wherein the inclination angle of the spray nozzle openings of the first and second group of spray nozzles, respectively, is substantially equal for each spray nozzle associated with its respective group, and is in the range of 15-60° with respect to said first and second spray nozzle axes, respectively.

12. The spray applicator according to claim 11, wherein said inclination angle is in the range of 20-45°.

13. The spray applicator according to claim 1, wherein each spray nozzle is associated with a valve connected to a control unit.

14. The spray applicator according to claim 13, wherein the control unit is configured to open and close said valve in a pulsing manner, such that a predetermined volume rate of fluid is ejected from each spray nozzle opening.

15. The spray applicator according to claim 14, wherein the control unit is configured to control the pulsing as a function of the speed of said web run through the spray applicator.

16. The spray applicator according to claim 1, further comprising an elongated chamber having a longitudinal centre axis, said web plane including said centre axis.

17. The spray applicator according to claim 16, wherein each spray nozzle associated with each valve is arranged at an inner wall of said chamber.

18. The spray applicator according to claim 13, wherein each valve is rotatably mounted so that the nozzle opening inclination angle of the associated spray nozzle is adjustable within a range of angles between 15 and 60°.

19. The spray applicator according to claim 1, wherein the spray applicator comprises a dual spray nozzle arrangement including said first and second groups of spray nozzles forming a first half of the dual spray nozzle arrangement on one side of the web plane, and a corresponding second half of said dual spray nozzle arrangement on the other side of the web plane, for spraying on both sides of the web.

20. A spray unit comprising a spray applicator for spraying a fluid onto a web of material, wherein the spay applicator comprises:

a first group of spray nozzles arranged along a first axis; and a second group of spray nozzles arranged along a second axis;

said first and second spray nozzle axes being arranged on the same side of a plane in which said web is to be run;

said first and second spray nozzle axes being spaced from each other and arranged substantially at the same distance from said web plane;

each spray nozzle having an elongated spray opening configured to spray fluid in a direction towards said web plane;

each nozzle of said first group of spray nozzles having its spray opening tilted a first nozzle opening inclination angle with respect to said first nozzle axis;

each nozzle of said second group of spray nozzles having its spray opening tilted a second nozzle opening inclination angle with respect to said second nozzle axis;

wherein said first nozzle opening inclination angle differs from said second nozzle opening inclination angle.

21. The spray applicator according to claim 1, wherein the web comprises fabric material.

22. The spray unit according to claim 20, wherein the web comprises fabric material.

23. The spray applicator according to claim 6, wherein said offset is 40-60% of the distance.

24. The spray applicator according to claim 18, wherein said range of angles is 20-45°.

* * * * *